US006150613A

United States Patent [19]

Bergstrom

[11] Patent Number: 6,150,613

[45] **Date of Patent: *Nov. 21, 2000**

[54] POWER TRANSFORMER AND COUPLING MEANS

[75] Inventor: Scott J. Bergstrom, Easton, Pa.

[73] Assignee: Jersey Central Power & Light Co., Morristown, N.J.

[ * ] Notice: This patent is subject to a terminal disclaimer.

[21] Appl. No.: 09/338,903

[22] Filed: Jun. 24, 1999

Related U.S. Application Data

[63] Continuation of application No. 08/843,893, Apr. 17, 1997.

[60] Provisional application No. 60/015,833, Apr. 19, 1996, and provisional application No. 60/016,266, Apr. 19, 1996.

[51] Int. Cl.[7] ..... H01B 17/26

[52] U.S. Cl. ..... 174/152 R; 174/153 R; 174/31 R

[58] Field of Search ..... 174/152 R, 153 R, 174/172, 31 R; 336/107, 137, 198; 439/371; 361/39

[56] References Cited

U.S. PATENT DOCUMENTS

| | | | |
|---|---|---|---|
| 1,723,000 | 8/1929 | Austin | 336/198 |
| 1,873,977 | 8/1932 | Naef | 336/198 |
| 3,235,823 | 2/1966 | Renberg | 336/12 |
| 3,462,645 | 8/1969 | Leonard | 336/107 |
| 3,697,819 | 10/1972 | Eichelberger et al. | 317/103 |
| 3,701,929 | 10/1972 | Taguchi et al. | 317/103 |
| 3,767,843 | 10/1973 | Stone | 174/142 |
| 3,944,847 | 3/1976 | Kinnear | 200/163 |
| 4,053,724 | 10/1977 | Llona | 200/51 |
| 4,353,611 | 10/1982 | Siebens et al. | 339/92 |
| 4,360,849 | 11/1982 | Harris et al. | 361/339 |
| 4,489,361 | 12/1984 | Kitamura | 361/33 |
| 4,863,392 | 9/1989 | Borgstrom et al. | 439/921 |
| 4,965,407 | 10/1990 | Hamm | 174/31 |
| 5,267,880 | 12/1993 | Tamm | 439/620 |
| 5,450,280 | 9/1995 | Wactor | 361/606 |
| 5,736,915 | 4/1998 | Goedde et al. | 336/55 |
| 5,808,536 | 9/1998 | Sandlin, Jr. et al. | 336/107 |
| 5,952,617 | 9/1999 | Bergstrom | 174/152 |

OTHER PUBLICATIONS

Balanced–Design Core–Form Transformers, Westinghouse, No date.
Liquid Filled Transformers, Virginia Transformer Corp., No. date.
Small Power Transformers, ABB, No date.
Pennsylvania Transformer Technology, Pennsylvania Technical Systems, No date.
Power Transformers, Delta Star, Inc., No date.
Single and Three Phase Liquid Filled Transformers, Ferrante–Packard Transformers, Dec. 1971.
Power Transformers, McGraw–Edison, No date.
Power Transformers, Kuhlman Power Transformer Division, No date.
Power Transformers, Porter, No date.
SF6 Gas Insulated Substation Equipment, Hitachi, No date.
Primary Substation Transformers from GE, General Electric, No date.
Power Transformers, Prolec, No date.
15kv Loadbreak Connectors, Power Cable Elbow Bushing Insert, Amerace, Inc., No date.
Waukesha A–Series PDS Substations, Magnetek, No date.

*Primary Examiner*—Kristine Kincaid
*Assistant Examiner*—W. David Walkenhorst
*Attorney, Agent, or Firm*—William Lawrence Muckelroy, Esq.; Gary Lipson, Esq.

[57] ABSTRACT

A power transformer is provided with a housing having a plurality of apertures for receipt of a bushing well of a bushing assembly. Each bushing assembly includes a bushing well adapted to be secure in one aperture of the power transformer, and a bushing adapted to be connected to a terminal in the bushing well to permit the conducting of electric current between the bushing assembly and the transformer. The bushing assembly further includes a connector for connecting the bushing conductor to a terminal positioned in the bushing well. The power transformer includes a cap to cover and isolate the unused bushing wells. The cap is preferably a plate structure that attaches to the lip of the bushing well and uses the dielectric formed by the air enclosed by the cap and the bushing well to prevent sparking over to adjacent sites, corona discharge, and accidental contact with a live terminal therein, and to guards against contamination of the bushing well.

23 Claims, 7 Drawing Sheets

POWER TRANSFORMER AND COUPLING MEANS

PRIORITY DATE AND CO-PENDENCY STATEMENT

This is a continuation application of pending application Ser. No. 08/843,893 filed Apr. 17, 1997 and claims the benefit of the filing thereof for all commonly disclosed subject matter. This application is related to U.S. patent application Ser. No. 08/843,937, now abandoned, filed on Apr. 17, 1997 bearing the same title and the same inventor. This application Ser. No. 08/843,893 and related U.S. patent application Ser. No. 08/843,937 are assigned to Jersey Central Power and Light Company, A United States Corporation, and commonly owned entirely by said Jersey Central Power and Light Company.

The applicant also hereby claims a priority filing date of Apr. 19, 1996 based on two separate provisional applications filed by the applicant having Ser. Nos. 60/015,833 and 60/016,266.

BACKGROUND

The present invention relates to Class I and Class II power transformers. More particularly, this invention relates to a universal power transformer that includes an internal design to produce one or more additional sets of bushing locations than exist on a standard transformer. The standard design of a transformer includes two sets of bushings, one set of bushings for high voltage and one set of bushings for low voltage. The transformer is then coupled with a means for easy attachment and detachment of the bushings to and from the power transformer. The present invention further includes a means for capping unused extensions in a power transformer, thus allowing the power transformer to be used in various substation designs which require different transformer arrangements and voltages. Accordingly, the present invention provides a coupling means for a power transformer such that the power transformer has the flexibility heretofore associated with distribution type transformers.

A grid of power lines typically distributes electricity at various voltages. These power lines originate from a source; namely, a main generator station. From the generating station, the lines carry the power to numerous substations on a power system. The voltage of this electricity at the generating station is stepped up for efficient conducting of electric power. Each substation contains a power transformer that is used to step down the voltage to lower levels for subsequent conducting through a distribution network. The distribution network includes numerous smaller distribution transformers, which lower the voltage to levels conveyed to commercial buildings, households, and other end users. Conventionally, the input voltage is called the primary voltage and the output voltage is called the secondary voltage.

Thus, there are two types of transformers used to convey electricity from a transmission system to a distribution system. These transformers are power transformers and distribution transformers.

Power transformers, which are used in the substations, must process far greater influxes of electric current and voltages than distribution type transformers. Each substation can have a unique layout depending on available space and type of equipment connected to the power transformer. The equipment connected could include switch gear, open bus conductor, etc. As such, power transformers are normally designed to conform to unique substation requirements.

Thus, it is sometimes difficult to utilize an inventoried power transformers as replacements. This difficulty occurs even within a single utility's electric system, as the power transformer available may not be of the necessary design configuration.

On the other hand, distribution type transformers are designed for much lower levels of electric power. Distribution transformers are typically much smaller in size and are not usually constrained by the installation site. In fact, most distribution transformers are mounted on utility poles, on ground level pads or placed under ground. The lack of design constraints for distribution transformers has resulted in a standardized design that is readily substitutable.

Heretofore, the prior art has failed to provide a similar flexibility for the power transformer class. Thus, there is a need for a new and novel universal power transformer. Such a novel universal transformer would reduce potential outage time as suitable replacements would be more readily available. The novel transformer would reduce the cost associated with new substations, as well as the transformer itself, since the multiple bushing location requirements of the user could be identified and standardized. The novel transformer with multiple bushing locations coupled with multi-rates primary or secondary voltages would even further extend the flexibility of the universal power transformer. The novel transformer would reduce the number of spare transformers needed to ensure system reliability, and would permit relocation of power transformers from one substation to another, or from one planned design to another. Such a new universal transformer would likely have the ability to connect properly and safely to the cables or ridged type bus carrying the power to and from the electric system.

Since each substation can have a unique layout, the novel universal transformer must be able to connect to an electrical power cable or a ridged type bus located in a variety of configurations. When a power transformer is specified for an individual substation, the particular power transformer is built to address the arrangement, ratings, and design concerns for that installation. Thus, for the power transformer to be useful in more than a single installation, the power transformer must be capable of accepting cables or ridged type bus connections at multiple locations located on the transformer exterior.

Accordingly, the novel invention provides multiple sets of bushing wells seated in apertures in a power transformer tank to provide the desired flexibility. Once a transformer arrangement is chosen and the installation is made to a new or existing substation, the remaining open bushing wells are capped to protect them from contamination, to reduce the likelihood of tracking, to insulate the live terminal from the environment, to prevent accidental contact with the live terminal at the base of the well, and to prevent corona activity from the live terminal. This cap becomes a dead front cover to the well. Installation of the cap reduces the potential for contamination from dirt, weather, birds and small animals. The unused bushing wells are covered for purposes of safety as well as for aesthetics.

The novel invention discloses live connections in multiple segments of the power transformer which require no switching devices. Thus, within the power transformer of this invention, multiple sets of permanent high voltage or low voltage connections are made depending on the users requirements. Unused wells are effectively capped or insulated from the environment in accordance with the disclosure of the invention. No method of switching or switching device occurs between the power transformer's permanent connections.

The novel invention discloses a bushing disconnect as a means to facilitate easy relocation of bushings from one segment or location to another segment or location. The removal of the bushing disconnect from the well does not require access into the power transformer itself as occurs required with the removal of a standard type oil immersed transformer bushing. Attachment of the bushing disconnect to the bushing well is accomplished with a simple type of connecting device. The bushing disconnect is air insulated on both the inside and outside of the bushing well.

The novel invention discloses that the removal or the relocation of a bushing disconnect from one segment of a power transformer to another segment of the transformer, could take as little as fifteen (15) minutes. The removal or relocation of a standard bushing in a standard type power transformer could take anywhere from several hours to two (2) to four (4) days to accomplish the required task. Removal or relocation of the bushing disconnect in fifteen (15) minutes as compared to two (2) to four (4) days for a standard bushing results in a substantial cost savings. The novel bushing disconnect also substantially reduces outage time which is required as a result of the removal or relocation of a bushing, eliminates possible oil spills, and reduces the risks that contaminants enter the power transformer.

The novel invention for the universal power transformer discloses a unique air gap between the bushing well and the bushing disconnect of a minimum volume sufficient to accommodate the incident of thermal expansion and to prevent corona activity. The distribution type bushing insert assemblies typically found on pad mount power transformers, used with underground cable systems, require that the assembly expel all the air between connecting parts to prevent corona activity. Often times a gap-filling lubricant is used to ensure a tight fit between the bushing and the bushing well.

U.S. Pat. No. 4,360,849 issued to Harris, et al. in 1982 discloses a complete substation modular package. The system as disclosed includes a transformer, primary circuit breakers, low voltage switch gear, and accessories required for the operation of the substation module. Harris teaches a design of a transformer where the high voltage bushing and low voltage bushing are in a fixed position. The Harris transformer design is adaptable to a single configuration. The power transformer described in the Harris design shows the low voltage bushings located in segment 1 on the side and the high voltage bushings in segment 3 on top, a standard design in the art for power transformer arrangements. These bushings are in a fixed location and this power transformer has no flexibility to adapt to other substation arrangements if needed. In addition, to remove a standard bushing in the low voltage position requires that the power transformer oil be drained to some point below the bottom connections of the bushings; the connections being internal to the transformer. After the oil is drained, the user enters the power transformer through port holes or manholes located on the transformer in order to gain access to the leads which are attached to the bottom of the bushings. The removal of these standard type bushings on the Harris design could reasonably take up to four (4) days to complete, including the oil processing, testing and replacement of the bushing.

U.S. Pat. No. 4,863,392 issued to Bergstrom, et al. in 1989 and assigned to Amerace, Inc. of Parsippany, N.J., refers to an improvement to a loadbreak bushing insert for use on distribution underground cable systems and equipment such as pad mount power transformers. This design may be used in conjunction with a power cable elbow and bushing insert as evidenced in a product provided by Amerace, Inc. and shown in a catalog entitled "15 kV Loadbreak Connectors Power Cable Elbow Bushing Insert," having the catalog number C-410M2 and issued on March 1989 (hereinafter referred to the "Amerace Design"). The Amerace Design is for underground distribution equipment connections. The bushing inserts as described in the Amerace Design, mate with the power cable elbow only for connection to underground cable systems and nothing else. The Amerace Design is for enclosed use only and is a dead front design. The dead front design refers to an ability to safely touch the equipment while the equipment is energized.

The Amerace Design bushing inserts are screwed onto the bushing well terminal or stud as depicted in U.S. Pat. No. 4,353,611, issued to Siebens, et al. in 1982. The Siebens' patent discloses an improvement to bushing well construction. Siebens teaches the use of a replaceable threaded stud, but does not provide for an improved connection between the bushing well and the bushing. The Siebens' patent discusses how the studs in prior art designs apparently snapped or were rather easily damaged. The bushing as disclosed in Siebens, is intended to work with underground distribution cables. The material as disclosed in Siebens cannot be used in conjunction with Class I or Class II power transformers.

The bushing design of the present invention can be distinguished from the bushing design as described in patent '611. The present invention is directed to an outdoor power bushing with outdoor air clearances and creep design. The present invention is not a dead front design, is not used in conjunction with underground cable installations, and does not break load for switching applications. The bushing design of the present invention incorporates a tulip type connection not threaded on the bottom and when installed connects to a stud or terminal molded into the bushing well specifically designed for this application with air clearances. On the top of the novel bushing, as disclosed herein, is a standard threaded conductor to connect to an outdoor bus work or bus duct via a stud connector. The novel bushing is designed to create a universal power transformer with a user friendly means of changing the bushings from one location on the power transformer to another location on the power transformer, or on a standard type power transformer to make bushing replacement simple and environmentally safe.

SUMMARY

Against the foregoing background, it is a primary object of the present invention to provide a power transformer that has a flexibility for use in different substation designs within a power system.

It is another object of the present invention to provide a novel power transformer that provides a plurality of apertures or sets of apertures in its tank, with each aperture adapted to receive a bushing well so that the power transformer can be readily used in a plurality of different substation configurations.

It is a further object of the present invention to provide a novel bushing assembly that has an air gap between the bushing and the bushing well sufficient to act as a dielectric between said bushing, said bushing well, and the grounded tank mounting surface without incidence of corona activity in the air gap.

It is a further object of the present invention to provide a novel bushing well that is sunken essentially entirely within the insulating fluid space within the power transformer to increase the insulating capacity of the bushing well on the transformer side.

It is a still further object of the present invention to provide such a novel power transformer with a plurality of bushing assemblies that have a biased or spring loaded coupling means attached to the bushing conductor terminal to facilitate connection of the bushing and the terminal at the base of the bushing well.

It is yet a further object of the present invention to provide such a novel power transformer having a plurality of live bushing wells therein that can be readily capped to protect them from contamination, to protect them against accidental contact with the live terminal at the base of each bushing well, and to guard against the incidence of corona activity generated by the live terminal in the bushing well.

To accomplish the foregoing objects and advantages, the present invention, in brief summary, comprises a power transformer having a plurality of apertures in its housing for receipt of a bushing well of a bushing assembly. Each bushing assembly includes a bushing well adapted to be secured in, and preferably sunken into, one aperture of the power transformer housing, and a bushing adapted to be connected to the bushing well to permit the conducting of electric current thereto. A gap between the walls of the bushing well and the bushing provides additional insulation. The bushing assembly further includes releasable means for coupling the bushing to an electric current terminal preferably positioned in the bushing well.

The power transformer further comprises a novel means for capping the unused bushing wells. The capping means is preferably a plate structure of the same dielectric material as the bushing well and attaches to the lip of the bushing well. The cap, coupled with the well and the dielectric formed by the air gap within the components, prevents corona activity or other unwanted electrical discharges. The cap also creates a dead front barrier to the terminal located within the bushing well to help prevent contamination within the well that may produce tracking, and to prevent accidental contact with the terminal.

DESCRIPTION OF THE PREFERRED EMBODIMENTS

Figure 1:
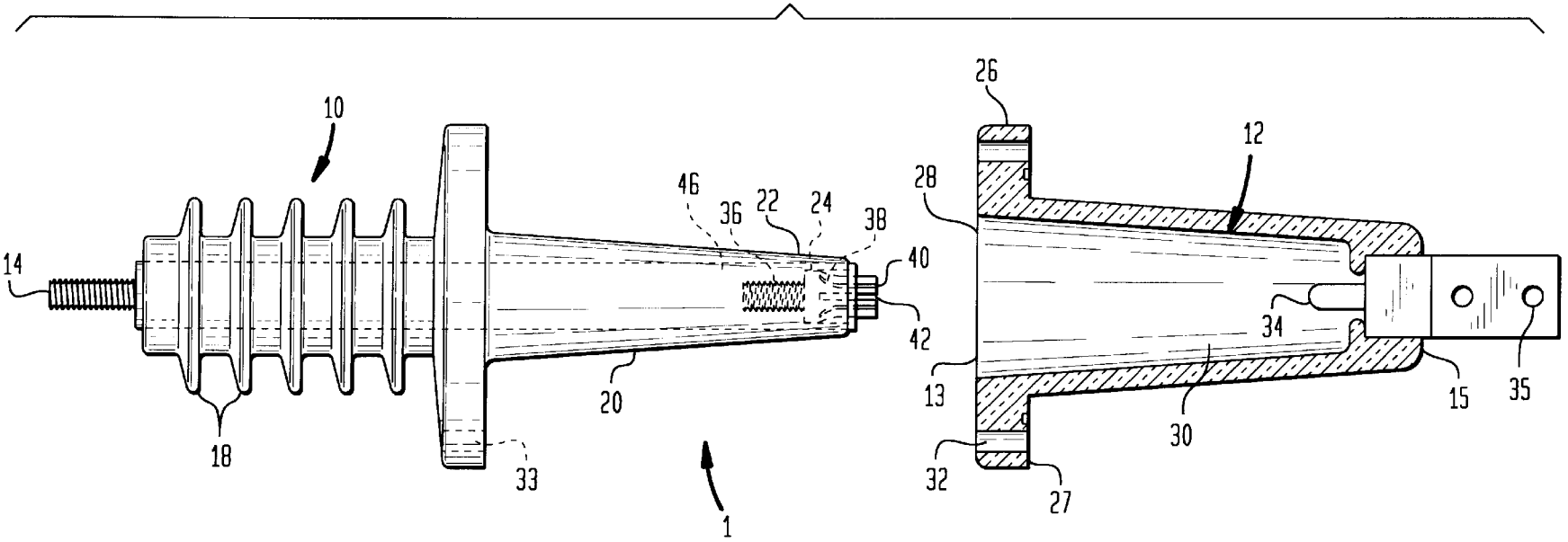
FIG. 1 is a side schematic view of an unassembled coupler assembly of a first embodiment of the present invention.

Referring to the figures and, in particular, FIG. 1, there is provided a new and novel bushing assembly generally referred to as reference numeral 1. The bushing assembly 1 has a bushing (or busing insert) 10 and a bushing well 12 adapted to receive the bushing.

The bushing well 12 has, in this embodiment, a conically shaped unthreaded body portion 20 as shown in FIG. 1 with a conical shaped unthreaded cavity 30. As shown in FIG. 1, the bushing 10 is nonadjacent or not adjacent the cavity 30. The bushing is spaced away from the cavity 30. The body has a first end 13 that includes an annular lip 26 having a central aperture 28 therethrough, and a second opposite end 15 having a terminal 34 preferably molded in place. The annular lip 26 of the bushing well 12 has a plurality of bores 32 therethrough.

The base 27 of the annular lip 26 will seat against a mounting boss 37 (see FIG. 2) on the exterior wall 45 (see FIG. 3) of the power transformer, effectively sinking the body of bushing well 12 into the power transformer and into the insulative oil, air or other gas contained therein. Only the outermost section of the well, immediately interior to the annular lip 26, would not be situated within the body of the power transformer and in insulating contact with the fluid in the power transformer.

The inside of the cavity 30 of the bushing well 12 has a conical shape sidewall that tapers inward in approximate conformance to, but spaced from, a tapered body portion 20 or surface of the bushing 10. The spacing of the inner surface of the bushing well 12 from the tapered body portion 20 of the bushing 10 provides a minimum volume of air surrounding the tapered body portion 20 that is not expelled when the bushing 10 is pressed into the bushing well 12. This volume of air functions as a dielectric to properly insulate the connection made between the bushing 10 and the bushing well 12 to prevent corona activity and corona creep along the bushing 10. It also functions as a cushion to accommodate the different thermal coefficients of expansion of the materials of the bushing assembly.

The terminal 34 of bushing well 12, which preferably is not threaded, extends into the cavity 30 through the second end 15 of the bushing well 12. The terminal 34 will ultimately conduct electrical power transferred to it from the internal lead of the transformer windings and transfer it via the coupler or connector 38 to the bushing conductor 46. Power transfer in the reverse direction, from the bushing conductor 46 to the transformer windings, is also possible via such a coupler 38. The terminal 34 has a plurality of holes 35 formed in the internal end thereof to provide attachment sites for cables or other means of conducting electrical power between the transformer winding and the terminal. Thus, in the context of the present invention, cables can be traditional electrical cables, bus systems, or any other current carrying members.

For the novel universal power transformer, there will be a number of sets of apertures about the body of the power transformer. Each aperture in the transformer housing is adapted to receive a bushing well 12. As discussed above, the power transformer housing will have a number of such sets of apertures for receipt of the bushing wells 12 so that the power transformer will have the ability to be adapted to existing substations and, thus, a variety of differently configured substations. As will be discussed below, the unused live bushing wells will need to be capped in order to avoid contaminating the unused wells, to provide protection against accidental contact with the live terminal at the base of the well, and to prevent corona activity and discharge. As referred to herein, a live bushing well contains a live terminal; a live terminal is one that is electrically charged due to its connection with the windings of the transformer interior. The novel aspect of this invention pertains to its use with a live bushing well having therein a live or electrically "hot" terminal.

Referring again to FIG. 1, the bushing 10 has a central annular flange 18 and a tapered body portion 20 that extends from the flange 18 and, terminates at a tip 22. The tip 22 of the tapered body portion 20 has an aperture 24 formed within conductor 46 therein. The bushing 10 also includes a plurality of circumferential ribs 16 on the opposite side of the flange 18 from tapered portion 20, that provide a greater electrical creep path required for electrical clearance in the uncontrolled environment external to the bushing well. The bushing 10 terminates at its distal end in a terminal 14. The terminal 14 preferably is threaded, and is adapted to attach to an incoming electrical cable connector (not shown). Electric current passes through the bushing 10 and the conductor 46 therein by conventional means known in the art.

The flange 18 has a plurality of bores 33 that, when the bushing 10 is positioned in the bushing well 12, align with the plurality of bores 32 of the lip 26 of the bushing well 12. The aligned bores 32 of the lip 26 and the bores 33 of the flange 18 are adapted to attach the bushing 10 to the bushing well 12, via bolts, clamps, or other conventional means. As discussed below, bores 32 are alternatively used to attach a cap to bushing well 12. An additional set of bores 35 of the lip 26 (see FIG. 2) are used to mount the bushing well 12 to the mounting boss 37 (See FIG. 2) of the power transformer.

The bushing 10 is composed of insulative material, such as porcelain or epoxy or other insulating compound, that surrounds a conductor 46. Terminal 14 and conductor 46 are made of conductive metal or other suitable material.

The coupler 38 is adapted to be secured within aperture 24. Preferably, the aperture 24 is threaded and adapted to receive a threaded portion 36 of coupler 38. In this preferred embodiment, the opposite end of coupler 38 has a frictional mount 40 that is designed to be pushed onto the terminal 34 to provide engagement between the bushing 10 and the terminal of the bushing well 12.

The frictional mount 40 has a tube-shaped wall 42 that is deformable and biased inward to provide adequate frictional attachment to terminal 34. In one embodiment, the wall 42 may be solid. Alternatively, the wall 42 may be composed of separate biasing fingers 43 (see FIG. 4). In addition, the coupler 38 may be integral or may consist of two independent parts. In a further preferred embodiment, the coupler 38 is a tulip connector. However, the coupler 38 can be any connector that has means, preferably threaded, for mating with aperture 24, and biasing or spring means that permit the coupler to connect readily to the terminal 34.

A variety of couplers can be substituted in these designs for tulip connector 38. Equivalent connectors known in the art include crimp pins and louvertac- and multilam-type bands, including those having spring-loaded or based arm elements. In some such designs, the friction-based attachment is supplemented with additional clamping or other securing means. The coupler 38 provides an adequate contact pressure, but is easily released, and is suited for use in a power transformer that handles higher current and voltage.

In this preferred embodiment, one aspect of the novel invention relates to the composition of the bushing well 12. In this embodiment the busing well 12 is composed of filled epoxy materials. Various formulations are available and are selected based on cost, manufacturability, and their physical and electrical performance. Also, the bushing well 12 is spaced from the bushing 10, in contrast with prior art bushing assemblies for distribution transformers having tightly fitting busing-to-bushing well contact. The structure according to the present invention incorporates an air gap between bushing well 12 and bushing 10, yet provides adequate insulation for the very high level of voltage transfer that must be insulated and the ensuing corona activity.

Figure 2:
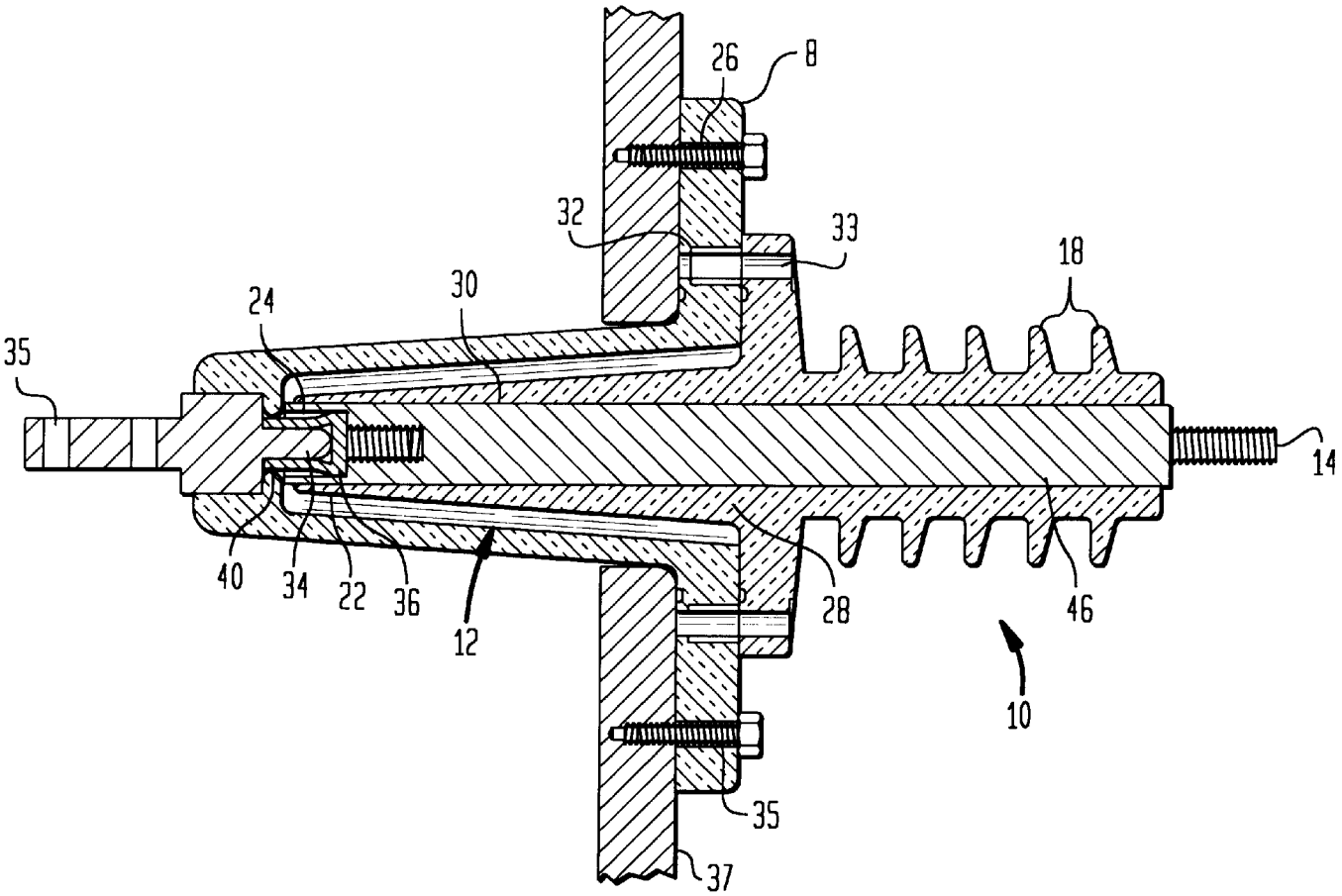
FIG. 2 is a side schematic view of the coupler assembly of FIG. 1, as assembled.

FIG. 2 shows the bushing 10 and the bushing well 12 in full engagement. The bores 32 of the lip 26 of the bushing well 12 and the bores 33 of the flange 18 of the busing 10 align to allow the lip 26 and flange 18 to be attached together by conventional means, such as, for example, bolting, clamping or the like. Gaskets 39 (Shown in FIG. 3) are placed between the lip 26 and the power transformer mounting boss 37, and alternatively between the lip 26 and the flange 18, or between the lip 26 and the cap 44 (See FIG. 3), depending on whether the well 12 is actively connected or capped. The outer surface of the flange 18 can be designed, as shown, to provide a flat surface for bolting or other connection. The conductor 46 is shown in its location within the bushing 10. The power transformer body can also have cooperating mounting bosses 37 or other means for mounting the assembly to and through its surface 45 (See FIG. 3).

FIGS. 3–5B show an alternate preferred embodiment of the bushing well 12 of the present invention. This structure varies from that of FIGS. 1 and 2 primarily in that its inner cavity 30 does not taper. The well walls form a generally cylindrical cavity as opposed to a frustoconical cavity. This allows the cavity 30 to conform to a non-tapered bushing 10 (see FIG. 4) and still provide the minimum of air dielectric between the bushing well 12 and the bushing 10 needed to prevent corona activity, primarily corona discharge. Thus, the well 12 is designed to conform to the shape of the bushing 10.

Figure 3:
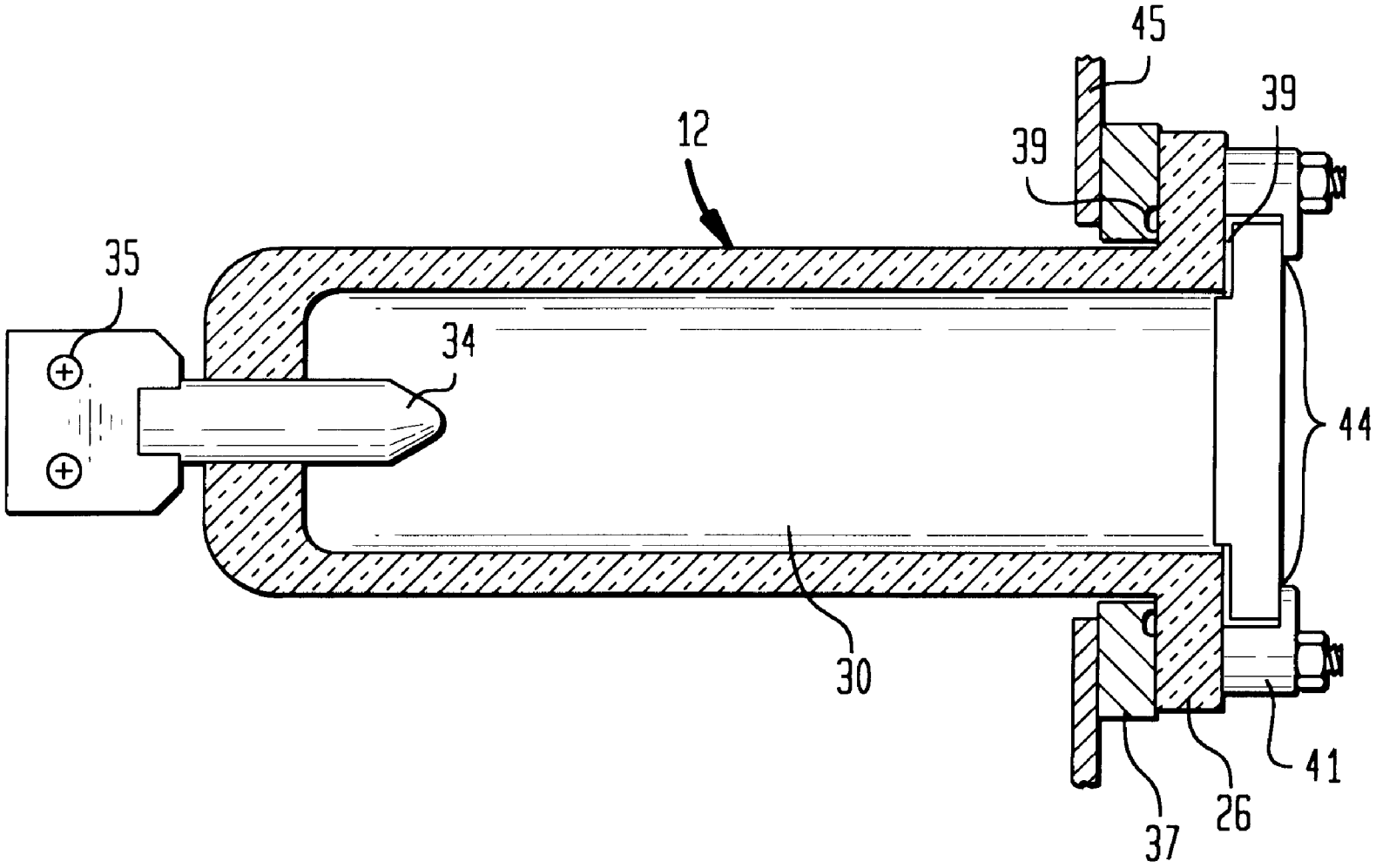
FIG. 3 is a schematic view of a bushing well and well cap of a second embodiment of the present invention.
Figure 6:
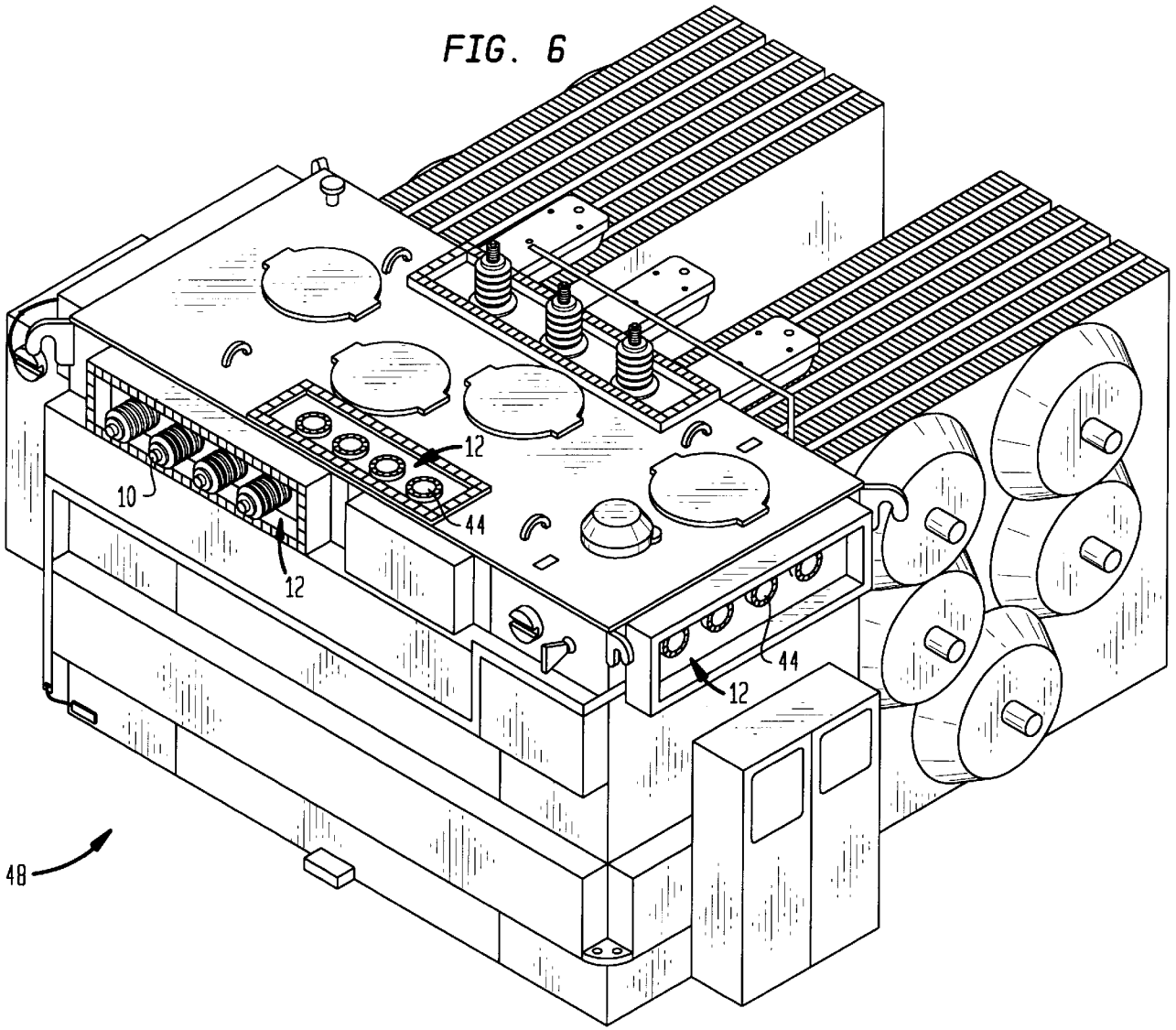
FIG. 6 is a diagram of a preferred electrical power transformer of the present invention demonstrating four sets of bushing wells, three sets of insulating well caps, and a set of low voltage bushings installed in one of the sets of bushing wells.

In addition, the well cap 44 is depicted here, in the absence of the bushing 10. The utility of the well cap 44 is not limited to the embodiment of FIG. 3. The well cap 44 is used on all bushing wells 12 not containing bushings 10. When well cap 44 is placed over the lip 26, it safely seals off live bushing well 12. Significantly, due to the size of cavity 30, the air contained within it, when sealed in by well cap 44, is sufficient to act as a dielectric to prevent sparking over to adjacent sites. This obviates the need for the insertion of a dielectric mass within bushing well 12 when not in use. The well cap 44 is preferably a flat plate having a surface that mates with lip 26. However, the well cap 44 can be any structure that closes or caps the unused bushing well 12. As shown in FIGS. 3 and 6, the well cap 44 may be a rounded cap having a central peak.

Figure 4:
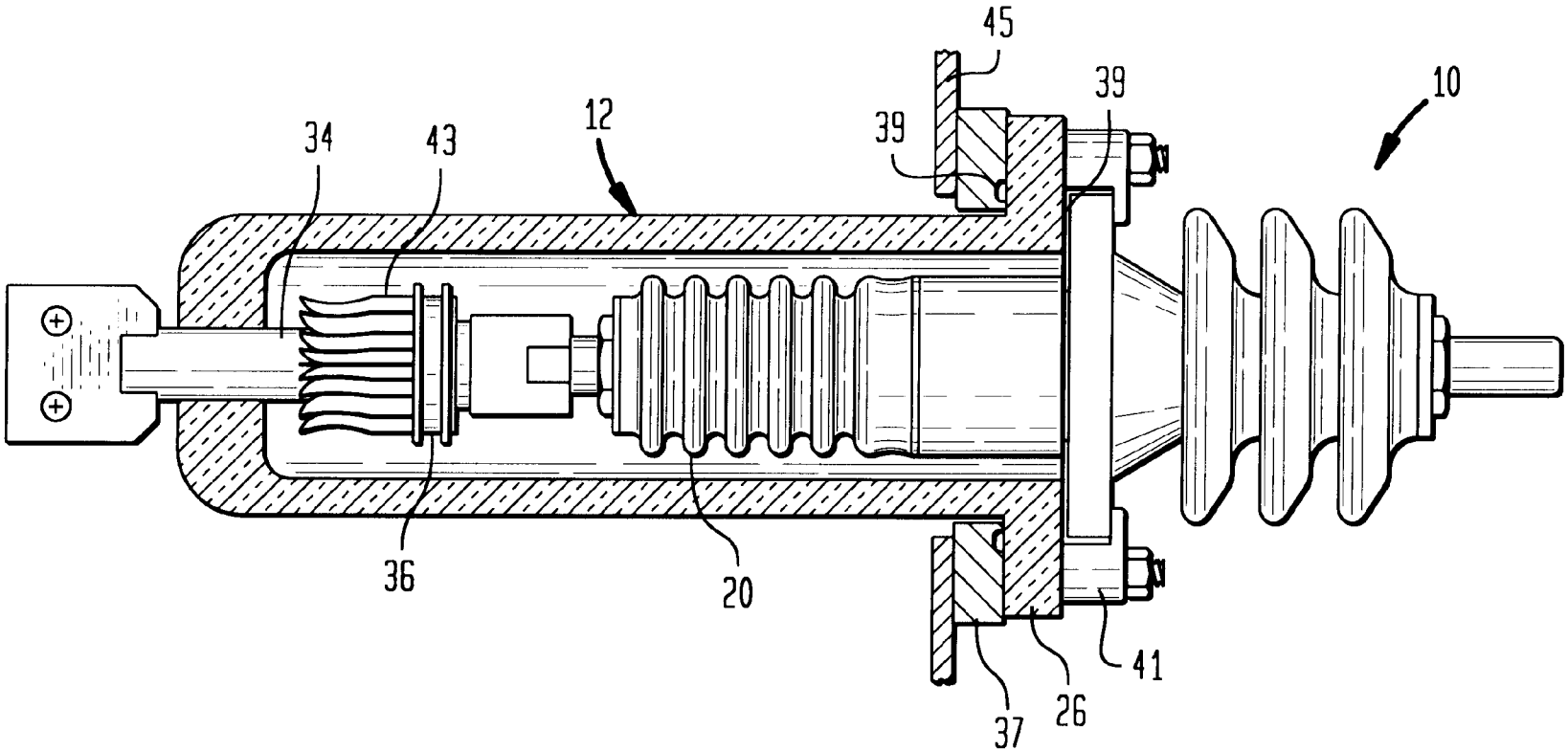
FIG. 4 is a schematic view of the bushing well of FIG. 3 attached to a further preferred embodiment bushing.

FIG. 4 depicts the gasket 39 disposed between the mounting boss 37 of the power transformer wall 45 and the lip 26 of the bushing well 12. A second gasket 39 is placed between the bushing flange 18 and the lip 26. Clamps 41 are used to affix the well cap 44 to the lip 26. FIG. 4 also shows the bushing well 12 of FIG. 3 with the associated bushing 10 connected thereto. Tulip connector 38 is connected by frictional engagement with terminal 34.

The bushing assembly 10 of FIG. 4 handles up to about 15 kV. It is anticipated that the assembly of the present invention can accommodate up to about 48 kV. Furthermore, in the prior art, power transformer connections typically required entry into the transformer environment, and thus, were not easily adjusted. While quick-disconnect or pullably removable connectors are known in the art of distribution transformers, these connectors are not designed to provide the current and voltage ratings necessary for use in a power transformer. Furthermore, the disclosed coupler design provides unique dielectric insulating properties not found in distribution connectors.

Figure 5B:
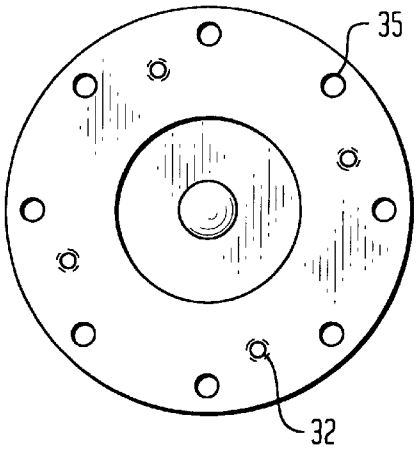
FIG. 5B is a front view of the lip of the bushing well of FIG. 5A showing the attachment bores.
Figure 5A:
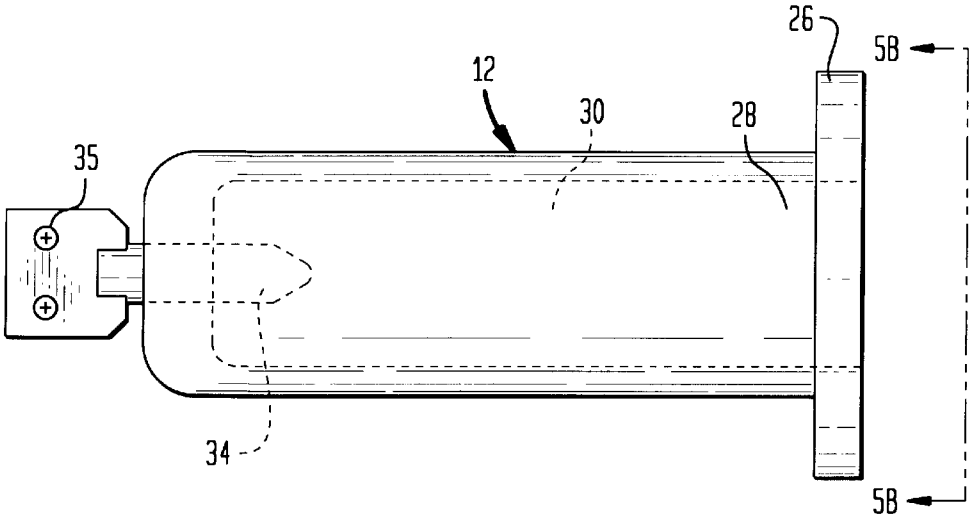
FIG. 5A is a schematic view of the bushing well of FIG. 3.

FIGS. 5A and 5B depict the bushing well 12 of FIGS. 3 and 4, and the offset bores 32 and 35 through lip 26 for attachment to flange 18 and to mounting boss 37, respectively.

FIG. 6 shows a coupler of the present invention in place in a power transformer having sets of four bushing wells 12 to accommodate grounded three-phase electrical connections. In other preferred embodiments, single phase or other types of electrical connections may be used, requiring multiple sets of one to six, or more, bushing wells. In the present embodiment, bushings 10 are shown in a first set of bushing wells 12 in the housing of power transformer 48. A second set of bushing wells 12 on a second face of the housing of the power transformer 48 are not in use, and thus do not contain bushings 10. Instead, well caps 44 are placed over these bushing wells 12. Each well cap 44 is mounted to lip 26 (see FIG. 1), preferably via bores 32 (see FIG. 1) and with the same bolting means otherwise used to join the bushings 10 to wells 12. Alternatively, each well cap 44 may be secured to lip 26 by conventional means, provided such means do not disturb the placement of the bushing well in the aperture of the power transformer housing.

Figure 7:
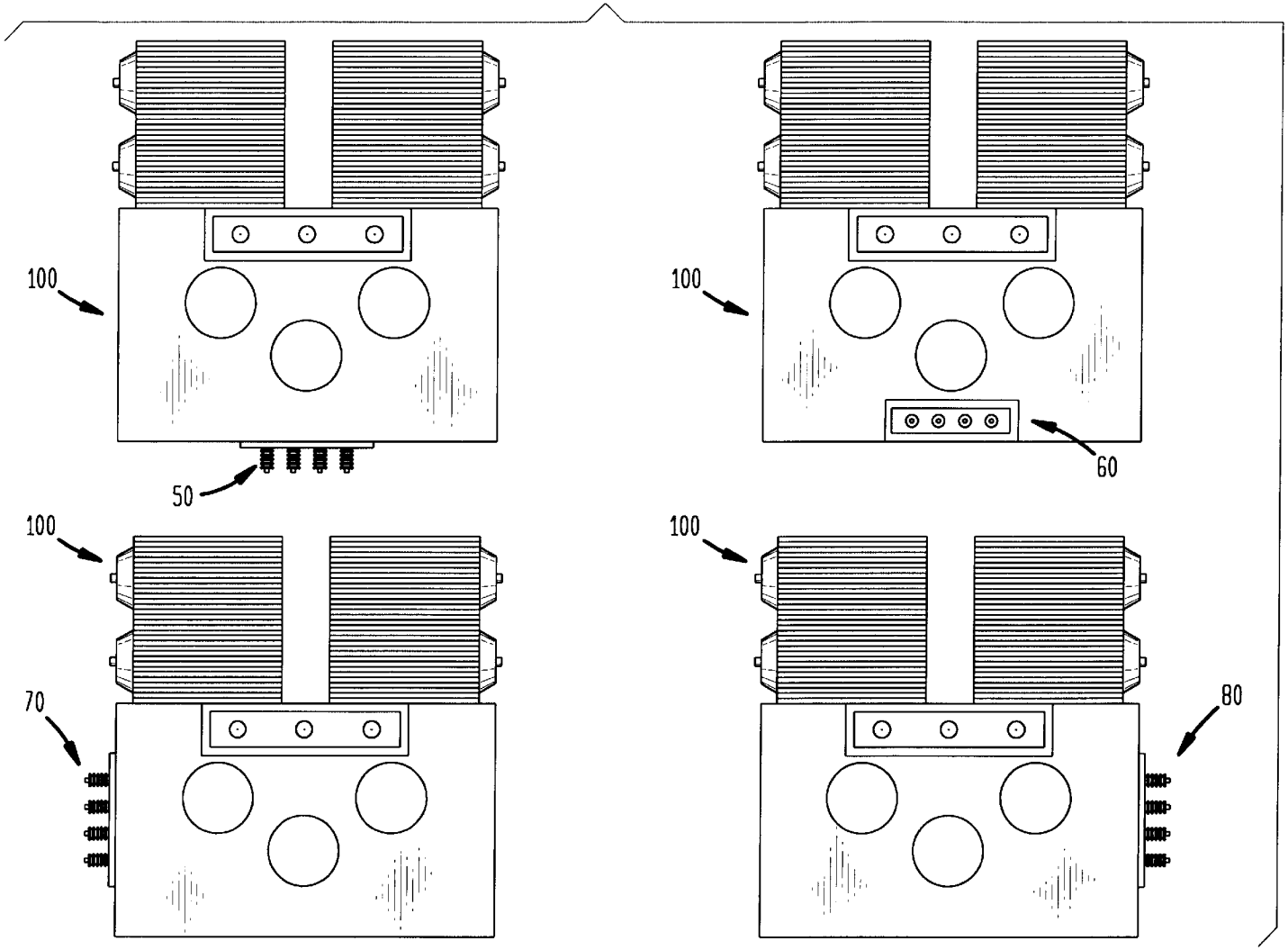
FIG. 7 depicts a transformer in four alternate design configurations.

In FIG. 7 a transformer is shown generally by numeral 100. FIG. 7 represents one contemplated situation in which a user may require the placement of low voltage bushings in various locations 50, 60, 70 and 80 on the transformer 100. This design requirement could be accomplished by the construction of four (4) transformers 100 as shown in FIG. 7, or each of the four (4) design requirements could be incorporated in a single transformer as shown in FIG. 6.

With the installation of sixteen (16) bushing wells 50, 60, 70 and 80 and one set of four bushing disconnects, the low voltage bushing disconnects of a transformer may be relocated to any one of four of the segments for all the required transformer designs (See FIGS. 6 and 7). As such, only one transformer 48 (See FIG. 6) for all applications is required for a particular rating. Providing a single transformer 48 results in a significant cost savings by reducing the number of ANSI tests required and also reducing the number of transformers maintained in inventory from four (4) to one (1). Transformers that exist in the current art provide for multi-rated high voltage and low voltage windings. Using the novel invention in combination with multi-rated winding further expands the flexibility of the use of the present invention by expanding the transformer design 48 represented in FIG. 6 from four (4) designs in a single transformer 48 to eight (8) designs. The application of this novel invention provides numerous flexible design combinations as never before see in the power transformer industry.

The invention having been thus described with particular reference to the preferred forms thereof, it will be obvious that various changes and modifications may be made therein without departing from the spirit and scope of the invention as defined in the appended claims.

What is claimed is:

1. A combination of a bushing and a power transformer for operating up to at least 15 kV, the power transformer having a plurality of live bushing wells, each live bushing well having a quick-connect means for unthreadedly receiving a bushing, the bushing and bushing well spaced sufficiently apart and forming a dielectric air gap therein between up to at least 15 kV, the power transformer having a mounting boss on an exterior wall and including insulative material therein, the bushing being removably unthreadedly secured within one of said bushing wells whereby the air gap dielectric combined with the removable unthreadedly secured bushing within the bushing well enables a pullable quick disconnection of the bushing from the bushing well.

2. The combination of a bushing and power transformer as claimed in claim 1, wherein the bushing well includes a cylindrically shaped body defining a cavity therein, the bushing well having a first end and a second end, the first end includes an annular lip having an aperture therethrough, and the annular lip further includes a plurality of bores therethrough; and the bushing well is secured to the mounting boss on the outside of the power transformer.

3. The combination of a bushing and power transformer as claimed in claim 2, wherein the bushing well includes a conically shaped body defining a conically body therein that tapers inward from the first end to the second end of the bushing well; and the bushing is tapered at one end, the bushing well is conically shaped defining a cavity therein, the conically shaped cavity tapering inward in substantial conformance to and spaced apart from the tapered end of the bushing.

4. The combination of a bushing and power transformer as claimed in claim 2, further including a terminal attached to the second end of the bushing well.

5. The combination of a bushing and power transformer as claimed in claim 4, wherein the terminal having a first end and a second end, the first end is positioned inside the bushing well and the second end extends outside of the bushing well; and the second end of the terminal including an attachment means for attaching conducting electrical power between the power transformer and the terminal.

6. The combination of a busing and power transformer as claimed in claim 2, wherein the bushing includes a central annular flange having a plurality of bores therethrough, the plurality of bores in the annular flange align with the plurality of bores in the annular lip of the bushing well to facilitate securing the bushing to the bushing well.

7. The combination of a bushing and power transformer as claimed in claim 6, wherein the aligned bores of the annular lip and the bores of the flange are adapted to secure the bushing to the bushing well using bolts.

8. The combination of a bushing and power transformer as claimed in claim 1, wherein the bushing has a first end and a second end, the second end of the bushing has an aperture defined therein, a coupler having a first end and a second end, the aperture is adapted to receive the first end of the coupler providing a secure connection thereto, the second end of the coupler is adapted to provide a secure connection to the second end of the terminal.

9. The combination of a bushing and power transformer as claimed in claim 8, wherein the coupler is a tulip connector.

10. The combination of a bushing and power transformer as claimed in claim 8, wherein the coupler is a louvertac-type connector.

11. The combination of a bushing and power transformer as claimed in claim 8, wherein the coupler is a multiam-type connector.

12. The combination of a bushing and power transformer as claimed in claim 1, wherein the bushing well has an inside wall, the bushing is nonadjacently spaced from the inside wall of the bushing well providing the air gap between the bushing and the inside wall of the bushing well.

13. A bushing having an outer surface in combination with a power transformer substantially filled with a removable insulating material, the bushing comprising an unthreaded bushing disconnect, the transformer having at least one live unthreaded bushing well having an inside wall, the transformer further having a plurality of like unthreaded bushing wells therein, the live unthreaded bushing well having a first bushing well end and a second bushing well end, the live unthreaded bushing well further having a terminal attached to the second bushing well end of the unthreaded bushing well, the unthreaded bushing disconnect being pullably removably secured to the second bushing well end at the terminal, the unthreaded bushing having a first bushing end and a second bushing end, a coupler having a first coupler end and a second coupler end, the bushing receiving the first coupler end and the unthreaded bushing providing a secure connection to the coupler, the second coupler end having an means for unthreadedly providing a secure connection to the terminal, the body of the bushing being separated from the inside of the bushing well by an air gap whereby a quick-disconnection of the bushing from the bushing well is provided.

14. The combination of a bushing and power transformer as claimed in claim 13, wherein the terminal is non-thread bearing.

15. The combination of a bushing and power transformer as claimed in claim 13, wherein the bushing well has an inside wall; and wherein the live bushing, when secured to the second end of the terminal, is spaced from the inside wall of the bushing well, whereby an insulating air gap is provided between the live bushing and the bushing well.

16. The combination of a bushing and power transformer as claimed in claim 13, wherein the coupler is a tulip connector.

17. The combination of a bushing and power transformer as claimed in claim 13, wherein the coupler is a louvertac-type connector.

18. The combination of a bushing and power transformer as claimed in claim 13, wherein the coupler is a multilam-type connector.

19. A universal bushing in combination with a power transformer, the power transformer comprising a plurality of live bushing wells each bushing well includes a first end and a second end, a terminal includes a proximal end and distal end, the terminal is secured to the second end of the bushing well, the distal end of the terminal is electrically coupled to the power transformer and the proximal end of the terminal extends within the bushing well, the universal bushing includes a first end and a second end and further comprises:

a slidable coupler, the slider coupler being fixed to the second end of the universal bushing; and a capping and insulating means for enclosing at least one of said live bushing wells.

20. A universal bushing in combination with a power transformer power transformer, the power transformer is adapted to receive a plurality of bushing wells, each bushing well includes a first end and a second end, a terminal includes a first end and a second end, the terminal is secured to the second end of the bushing well, the first end of the terminal is electrically coupled to the power transformer and the second end of the terminal extends within the bushing well, the universal bushing and power transformer comprises:

A housing, the housing includes a plurality of apertures arranged to enable the power transformer for use in a plurality of substation configurations;

the power transformer includes the plurality of bushing wells wherein each of said live bushing wells is received by a corresponding aperture and each of said live bushing wells is secured to the housing;

each of said live bushing wells is of a cylindrical shape that defines an aperture therein, each of said live bushing wells has a first end and a second end, each of said live bushing wells further includes a terminal, the terminal is attached to the second end of each of said live bushing wells;

the terminal has a first end and a second, the first end of the terminal extends into the power transformer, the distal end of the terminal is electrically coupled to the power transformer, the proximal end of the terminal extends inside the live bushing well;

a bushing, the first end of the terminal is adapted for coupling to the bushing; and a plurality of removable capping means, one each for enclosing each of said live bushing wells whereby undesirable electrical discharge from a live bushing well is prevented.

21. A universal bushing and power transformer combination, the power transformer containing removable insulative material, and the power transformer comprising at least one universal bushing, the universal bushing and power transformer combination comprises:

the power transformer includes a housing, the housing includes a plurality of apertures;

a plurality of live bushing wells, the plurality of live bushing wells being electrically live, each of said live bushing wells adapted to be received by a corresponding aperture in the housing and each of said live bushing wells being secured to said housing;

each of said live bushing wells including an inside wall and being cylindrically shaped and further defining an aperture therein, each of said live bushing wells having a first end and a second end, a terminal being detachably affixed to the second end of each of said live bushing wells;

the terminal including a first end and a second end, the first end of the terminal extending into the power transformer and the second end of the terminal extending inside each of said live bushing wells, the first end of the terminal being electrically coupled to the power transformer;

a universal bushing further including a slidable coupler, the slidable coupler being removably fixed to the first end of the terminal whereby in the event of a non-operable universal bushing, the non-operable universal bushing being removable from the power transformer and an operable removable universal bushing being connectable inside the power transformer without removal of the insulative material contained within the housing of said power transformer, the universal bushing being spaced from the inside wall of each of said bushing wells whereby an electrically insulating air gap is provided between the universal bushing and each of said live bushing wells; and a capping means for enclosing at least one of said electrically live bushing wells to prevent undesirable electrical discharge.

22. A universal bushing and power transformer combination as claimed in claim 21, wherein the housing includes four locations, each of said locations contains at least one bushing well, and each of said bushing wells is configured to accept a universal bushing, enabling the power transformer to be configured into any one of four substation configurations.

23. A universal bushing in combination with a power transformer, the power transformer having a housing with a plurality of faces, the power transformer comprises a plurality of bushing wells, the bushing wells being live and divided into sets, at least one of said plurality of bushing wells being located on one of said faces and at least another set of said plurality of bushing wells being located on another of said faces, each bushing well including a first end and a second end, a terminal including a first end and a second end, the terminal being secured to the second end of the bushing well, the first end of the terminal being electrically coupled to the power transformer and the second end of the terminal extending within the bushing well, the universal bushing comprising:

A coupler, the universal bushing includes a first end and a second end, the coupler being fixed to the second end of the universal bushing; and an insulating capping means for enclosing and sealing at least one of aid bushing wells within the power transformer housing, the power transformer further comprising at least one capped live bushing well whereby electrical discharge is prevented and whereby a variety of configurations for the bushings and the capped bushing wells of the power transformer are available.

* * * * *

UNITED STATES PATENT AND TRADEMARK OFFICE

CERTIFICATE OF CORRECTION

PATENT NO. : 6,150,613
DATED : November 21, 2000
INVENTOR(S) : Scott J. Bergstrom It is certified that error appears in the above-identified patent and that said Letters Patent is hereby corrected as shown below:

Drawings,
In Figure 1, change "18" to -- 16 --.
In Figure 2, change "18" to -- 16 --.
In Figure 2, at number "28", delete the portion of the adjacent lead line extending into the surface of item number "10".
In Figure 2, change "28" to -- 18 --.
In Figure 2, change "30" to -- 28 --.

Signed and Sealed this

Twenty-fifth Day of December, 2001

*Attest:*

*Attesting Officer*

JAMES E. ROGAN
*Director of the United States Patent and Trademark Office*